US007233900B2

(12) United States Patent
Kariya

(10) Patent No.: US 7,233,900 B2
(45) Date of Patent: Jun. 19, 2007

(54) WORD SEQUENCE OUTPUT DEVICE

(75) Inventor: Shinichi Kariya, Kanagawa (JP)

(73) Assignee: Sony Corporation, Tokyo (JP)

( * ) Notice: Subject to any disclaimer, the term of this patent is extended or adjusted under 35 U.S.C. 154(b) by 742 days.

(21) Appl. No.: 10/297,374

(22) PCT Filed: Apr. 5, 2002

(86) PCT No.: PCT/JP02/03423

§ 371 (c)(1),
(2), (4) Date: Jul. 3, 2003

(87) PCT Pub. No.: WO02/082423

PCT Pub. Date: Oct. 17, 2002

(65) Prior Publication Data

US 2004/0024602 A1 Feb. 5, 2004

(30) Foreign Application Priority Data

Apr. 5, 2001 (JP) ..... 2001-107476

(51) Int. Cl.
*G10L 13/02* (2006.01)
*G10L 13/04* (2006.01)

(52) U.S. Cl. ..... 704/260; 704/258; 704/261

(58) Field of Classification Search ..... 704/260, 704/275, 235

See application file for complete search history.

(56) References Cited

U.S. PATENT DOCUMENTS 4,400,787 A * 8/1983 Mandel et al. ..... 704/270

(Continued)

FOREIGN PATENT DOCUMENTS

EP 0 893 308 1/1999

(Continued)

OTHER PUBLICATIONS

Breazeal,Cynthia L. "Sociable Machines: Expressive Social Exchange Between Humans and Robots," May 2000, MIT, pp. 1-264.*

(Continued)

*Primary Examiner*—David Hudspeth
*Assistant Examiner*—Youssef El Shafie
(74) *Attorney, Agent, or Firm*—Frommer Lawrence & Haug LLP; William S. Frommer; Paul A. Levy

(57) ABSTRACT

The present invention relates to a word sequence output device in which emotional synthetic speech can be output. The device outputs emotional synthetic speech. A text generating unit 31 generates spoken text for synthetic speech by using text as a word sequence included in action command information in accordance with the action command information. An emotion checking unit 39 checks an emotion model value and determines whether or not the emotion of a robot is aroused based on the emotion model value. Further, when the emotion of the robot is aroused, the emotion checking unit 39 instructs the text generating unit 31 to change the word order. The text generating unit 31 changes the word order of the spoken text in accordance with the instructions from the emotion checking unit 39. Accordingly, when the spoken text is "Kimi wa kirei da." (You are beautiful.), the word order is changed to make a sentence "Kirei da, kimi wa." (You are beautiful, you are.) The present invention can be applied to a robot outputting synthetic speech.

5 Claims, 6 Drawing Sheets

U.S. PATENT DOCUMENTS

| | | | | |
|---|---|---|---|---|
| 4,412,099 | A * | 10/1983 | Niyada et al. | 704/258 |
| 5,634,083 | A * | 5/1997 | Oerder | 704/253 |
| 5,746,602 | A | 5/1998 | Kikinis | |
| 6,337,552 | B1 * | 1/2002 | Inoue et al. | 318/568.2 |
| 6,445,978 | B1 * | 9/2002 | Takamura et al. | 700/245 |
| 6,665,641 | B1 * | 12/2003 | Coorman et al. | 704/260 |
| 6,839,670 | B1 * | 1/2005 | Stammler et al. | 704/251 |
| 2001/0021907 | A1 * | 9/2001 | Shimakawa et al. | 704/260 |
| 2002/0098879 | A1 * | 7/2002 | Rheey | 463/1 |

FOREIGN PATENT DOCUMENTS

| | | |
|---|---|---|
| JP | 57-121573 | 7/1982 |
| JP | 7-104778 | 4/1995 |
| JP | 10-260976 | 9/1998 |
| JP | 11-505054 | 5/1999 |
| JP | 11-175081 | 7/1999 |
| JP | 11-259271 | 9/1999 |
| JP | 2000-215993 | 8/2000 |
| JP | 2000-267687 | 9/2000 |
| JP | 2001-154681 | 6/2001 |
| JP | 2001-188553 | 7/2001 |
| WO | WO 97/32300 | 9/1997 |

OTHER PUBLICATIONS

Janet E Cahn: "The Generation of Affect in Synthesized Speech" Journal of the American I/O Society, vol. 8, Jul. 1990, pp. 1-19, XP002183399.

Koutny I; Olaszy G; Olaszy P: "Prosody prediction from text in Hungarian and its realization in TTS conversion" International Journal of Speech Technology, vol. 3, No. 3-4, Dec. 2000, pp. 187-200, XP007900200.

* cited by examiner

WORD SEQUENCE OUTPUT DEVICE

TECHNICAL FIELD

The present invention relates to a word sequence output device. Particularly, the present invention relates to a word sequence output device for realizing a robot which performs emotionally expressive speech by changing the word order of a word sequence forming a sentence output in a form of synthetic speech by a speech synthesizer based on the state of the emotion of an entertainment robot.

BACKGROUND ART

For example, a known speech synthesizer generates synthetic speech based on text or pronunciation symbols which are obtained by analyzing the text.

Recently, a pet-type pet robot which includes a speech synthesizer so as to speak to a user and perform conversation (dialogue) with the user has been proposed.

Further, a pet robot which has an emotion model for expressing the state of emotion has been proposed. This type of robot follows or does not follow the order of the user depending on the state of emotion indicated by the emotion model.

Accordingly, if synthetic speech can be changed in accordance with an emotion model, synthetic speech according to the emotion can be output, and thus the entertainment characteristic of pet robots can be developed.

DISCLOSURE OF INVENTION

The present invention has been made in view of these conditions, and it is an object of the present invention to output emotionally expressive synthetic speech.

A word sequence output device of the present invention comprises output means for outputting a word sequence in accordance with control of an information processor; and changing means for changing the word order of the word sequence output by the output means based on the internal state of the information processor.

A method of outputting a word sequence of the present invention comprises an output step for outputting a word sequence in accordance with control of an information processor; and a changing step for changing the word order of the word sequence output in the output step, on the basis of the internal state of the information processor.

A program of the present invention comprises an output step for outputting a word sequence in accordance with control of an information processor; and a changing step for changing the word order of the word sequence output in the output step, on the basis of the internal state of the information processor.

A recording medium of the present invention contains a program comprising an output step for outputting a word sequence in accordance with control of an information processor; and a changing step for changing the word order of the word sequence output in the output step, on the basis of the internal state of the information processor.

In the present invention, the word sequence is output in accordance with control of the information processor. On the other hand, the word order of the output word sequence is changed based the internal state of the information processor.

BEST MODE FOR CARRYING OUT THE INVENTION

Figure 1:
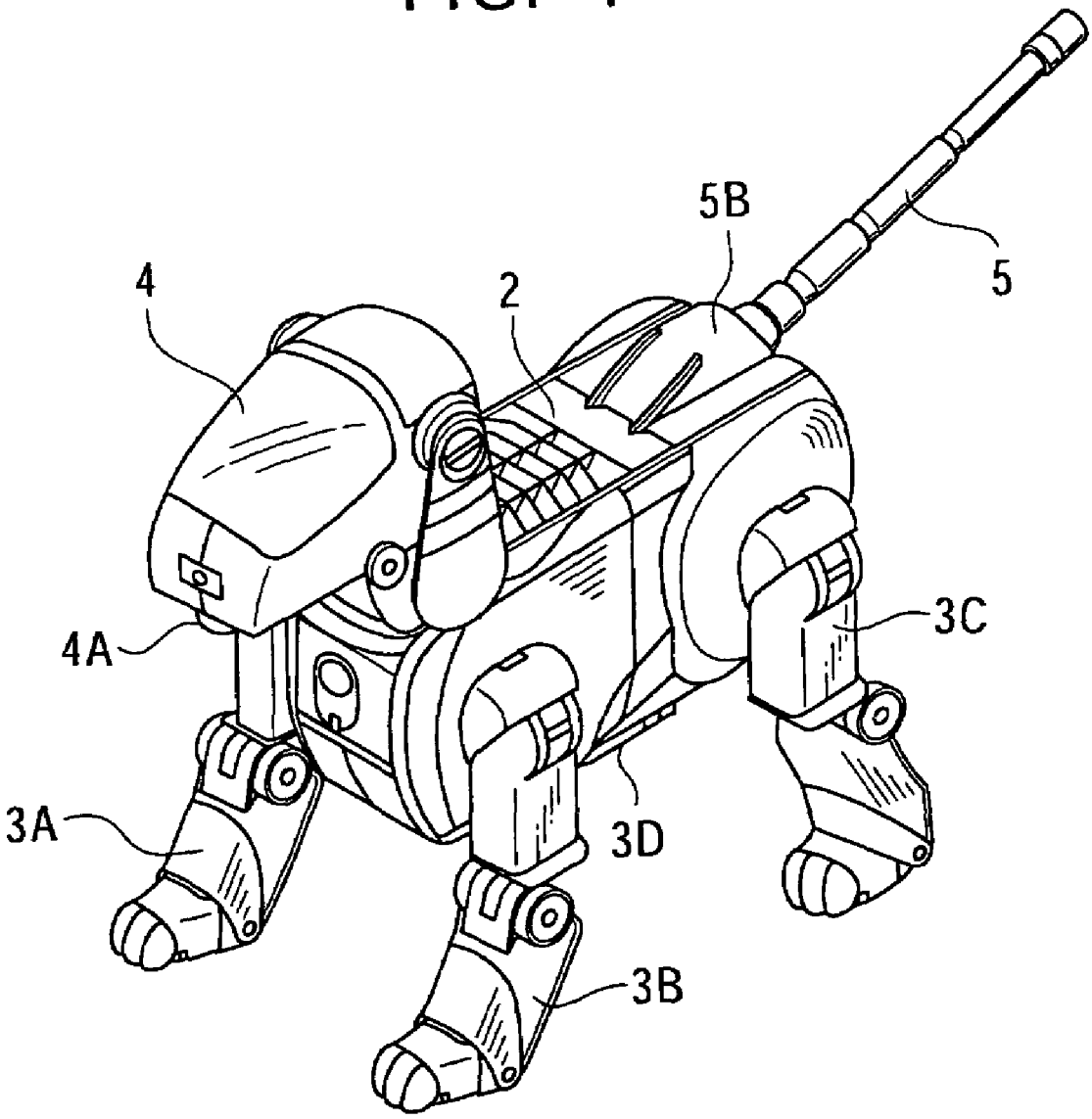
FIG. 1 is a perspective view showing an example of the external configuration of a robot according to an embodiment of the present invention.
Figure 2:
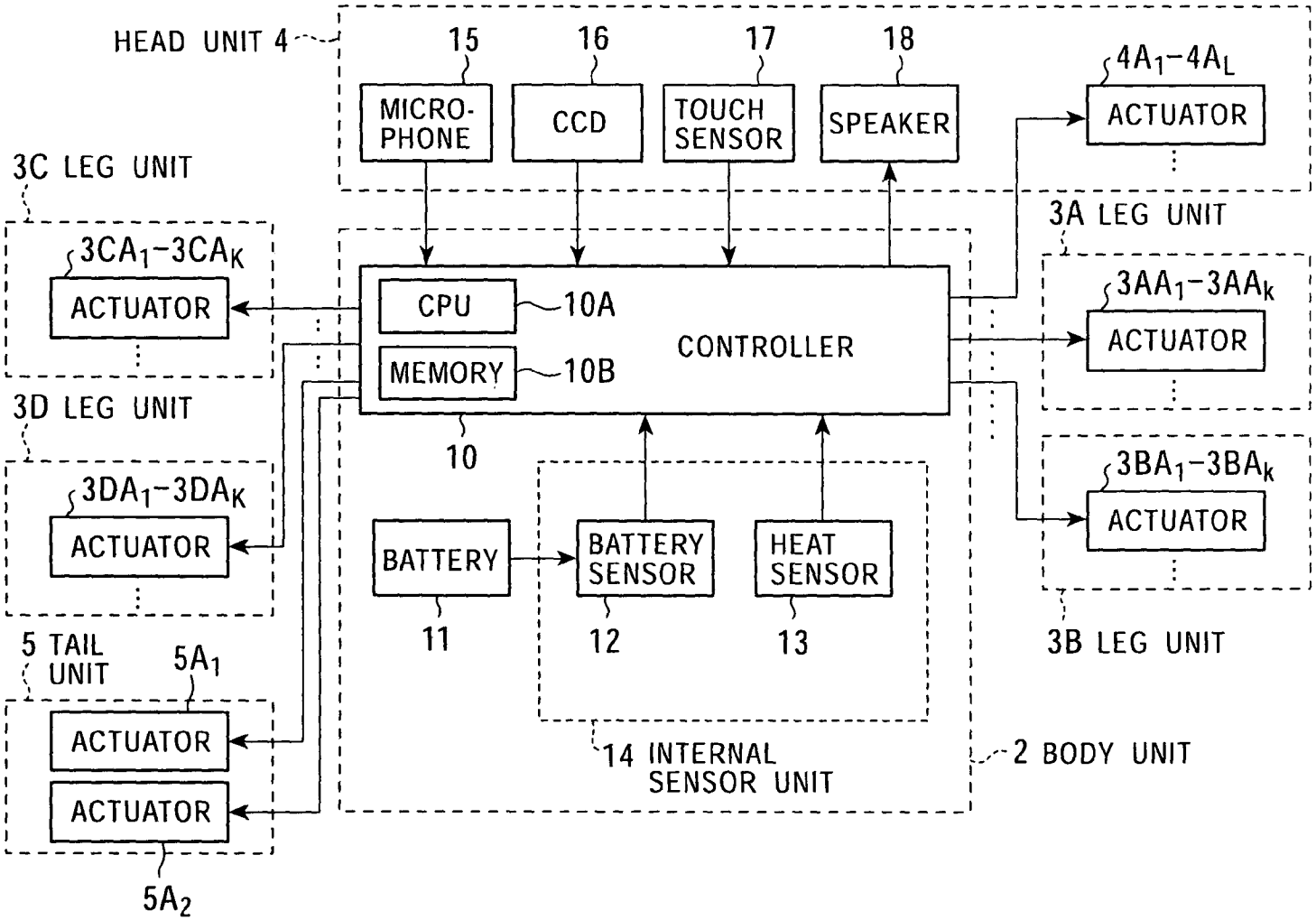
FIG. 2 is a block diagram showing an example of the internal configuration of the robot.

FIG. 1 shows an example of the external configuration of a robot according to an embodiment of the present invention. FIG. 2 shows the electrical configuration thereof.

In this embodiment, the robot is in the form of a four-legged animal, such as a dog. Leg units 3A, 3B, 3C, and 3D are connected to the front and back of both sides of a body unit 2, respectively, and a head unit 4 and a tail unit 5 are connected to the front and back end of the body unit 2, respectively.

The tail unit 5 extends from a base portion 5B, which is provided on the upper surface of the body unit 2, with two degrees of freedom so that the tail unit can be bent or wagged.

The body unit 2 accommodates a controller 10 for controlling the overall robot, a battery 11 serving as a power source of the robot, and an internal sensor unit 14 including a battery sensor 12 and a heat sensor 13.

The head unit 4 includes a microphone 15 corresponding to ears, a charge coupled device (CCD) camera 16 corresponding to eyes, a touch sensor 17 corresponding to a sense of touch, and a speaker 18 corresponding to a mouth, which are provided in predetermined positions. Further, a lowerjaw portion 4A corresponding to a lowerjaw of the mouth is movably attached to the head unit 4 with one degree of freedom. When the lowerjaw portion 4A moves, the mouth of the robot is opened or closed.

As shown in FIG. 2, actuators $3AA_1$ to $3AA_k$, $3BA_1$ to $3BA_k$, $3CA_1$ to $3CA_k$, $3DA_1$ to $3DA_k$, $4A_1$ to $4A_L$, and $5A_1$ and $5A_2$ are provided in the joints of the leg units 3A to 3D, the joints between the leg units 3A to 3D and the body unit 2, the joint between the head unit 4 and the body unit 2, the joint between the head unit 4 and the lowerjaw portion 4A, and the joint between the tail unit 5 and the body unit 2, respectively.

The microphone 15 in the head unit 4 captures environmental voices (sounds) including the speech of a user and outputs an obtained speech signal to the controller 10. The CCD camera 16 captures an image of the environment and outputs an obtained image signal to the controller 10.

The touch sensor 17 is provided, for example, on the upper portion of the head unit 4. The touch sensor 17 detects a pressure generated by a user's physical action such as patting or hitting, and outputs the detection result as a pressure detection signal to the controller 10.

The battery sensor 12 in the body unit 2 detects the remaining energy in the battery 11 and outputs the detection result as a remaining energy detection signal to the controller 10. The heat sensor 13 detects the heat inside the robot and outputs the detection result as a heat detection signal to the controller 10.

The controller 10 includes a central processing unit (CPU) 10A and a memory 10B. The CPU 10A executes a control program stored in the memory 10B so as to perform various processes.

That is, the controller 10 detects the environmental state, a command from the user, and an action of the user, on the basis of a speech signal, image signal, pressure detection signal, remaining energy detection signal, and heat detection signal supplied from the microphone 15, the CCD camera 16, the touch sensor 17, the battery sensor 12, and the heat sensor 13.

Further, the controller 10 decides the subsequent action based on the detection result and so on, and drives the necessary actuator from among the actuators $3AA_1$ to $3AA_k$, $3BA_1$ to $3BA_K$, $3CA_1$ to $3CA_K$, $3DA_1$ to $3DA_K$, $4A_1$ to $4A_L$, $5A_1$, and $5A_2$ based on the decision. Accordingly, the head unit 4 can be shook from side to side and up and down, and the lowerjaw portion 4 can be opened and closed. In addition, the controller 10 allows the robot to act, for example, to walk by moving the tail unit 5 and driving each of the leg units 3A to 3D.

Also, the controller 10 generates synthetic speech as required so that the synthetic speech is supplied to the speaker 18 and is output, and turns on/off or flashes light-emitting diodes (LED) (not shown) provided at the positions of the eyes of the robot.

In this way, the robot autonomously acts based on the environmental state and so on.

Incidentally, the memory 10B can be formed by a memory card which can be easily attached and detached, such as a Memory Stick®.

Figure 3:
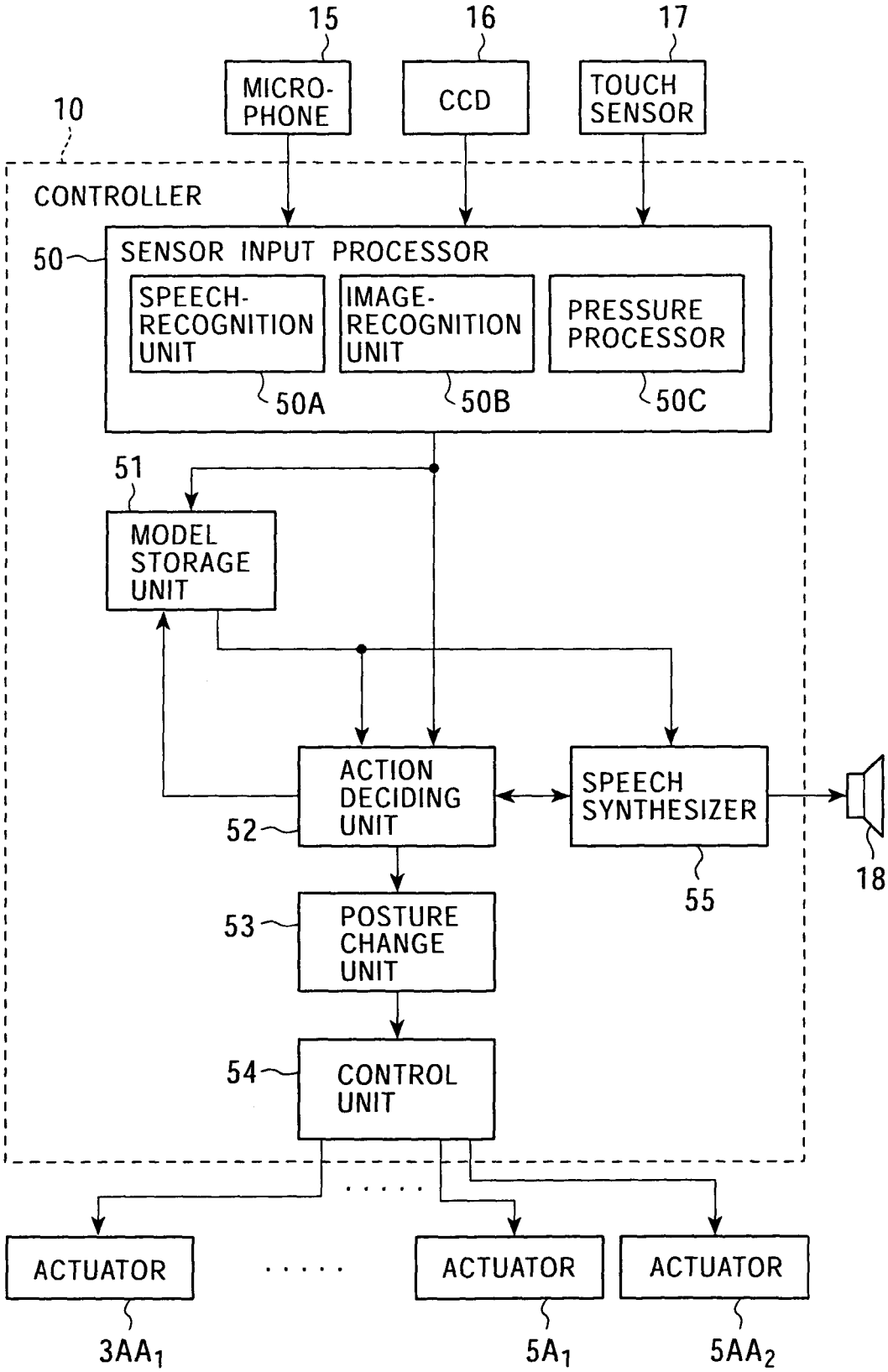
FIG. 3 is a block diagram showing an example of the functional configuration of a controller 10.

FIG. 3 shows an example of the functional configuration of the controller 10 shown in FIG. 2. The functional configuration shown in FIG. 3 is realized when the CPU 10A executes the control program stored in the memory 10B.

The controller 10 includes a sensor input processor 50 for recognizing a specific external state; a model storage unit 51 for accumulating recognition results generated by the sensor input processor 50 so as to express the state of emotions, instincts, and growth; an action deciding unit 52 for deciding the subsequent action based on the recognition result generated by the sensor input processor 50; a posture change unit 53 for allowing the robot to act based on the decision generated by the action deciding unit 52; a control unit 54 for driving and controlling each of the actuators $3AA_1$ to $5A_1$ and $5A_2$; and a speech synthesizer 55 for generating synthetic speech.

The sensor input processor 50 recognizes a specific external state, a specific action of the user, a command from the user, and so on based on a speech signal, an image signal, and a pressure detection signal supplied from the microphone 15, the CCD camera 16, and the touch sensor 17. Further, the sensor input processor 50 notifies the model storage unit 51 and the action deciding unit 52 of state recognition information indicating the recognition result.

That is, the sensor input processor 50 includes a speech-recognition unit 50A, which recognizes speech based on the speech signal supplied from the microphone 15. Then, the speech-recognition unit 50A notifies the model storage unit 51 and the action deciding unit 52 of commands, for example, "Walk", "Lie down", and "Run after the ball" generated from a speech recognition result, as state recognition information.

Also, the sensor input processor 50 includes an image-recognition unit 50B, which performs image-recognition processing by using the image signal supplied from the CCD camera 16. Then, after the processing, the image-recognition unit 50B notifies the model storage unit 51 and the action deciding unit 52 of image-recognition results as state recognition information, such as "There is a ball" and "There is a wall", when the image-recognition unit SOB detects, for example, "a red and round object" and "a flat surface which is perpendicular to the ground and which has a height higher than a predetermined level".

Furthermore, the sensor input processor 50 includes a pressure processor 50C, which processes the pressure detection signal supplied from the touch sensor 17. Then, after the process, the pressure processor 50C recognizes "I was hit (scolded)" when it detects a short-time pressure whose level is at a predetermined threshold or higher, and recognizes "I was patted (praised)" when it detects a longtime pressure whose level is lower than the predetermined threshold. Also, the pressure processor 50C notifies the model storage unit 51 and the action deciding unit 52 of the recognition result as state recognition information.

The model storage unit 51 stores and manages an emotion model, an instinct model, and a growth model representing the state of the emotion, instinct, and growth of the robot, respectively.

Herein, the emotion model represents the state (level) of emotions such as "joy", "sadness", "anger", and "delight" with a value within a predetermined range (for example, −1.0 to 1.0), and varies the value in accordance with the state recognition information transmitted from the sensor input processor 50 and an elapsed time. The instinct model represents the state (level) of desire which comes from instincts such as "appetite", "instinct to sleep", and "instinct to move" with a value within a predetermined range, and varies the value in accordance with the state recognition information transmitted from the sensor input processor 50 and an elapsed time. The growth model represents the state (level) of growth such as "infancy", "adolescence", "middle age", and "senescence" with a value within a predetermined range, and varies the value in accordance with the state recognition information transmitted from the sensor input processor 50 and an elapsed time.

The model storage unit 51 outputs state information, that is, the state of emotion, instinct, and growth indicated by the value of the emotion model, the instinct model, and the growth model to the action deciding unit 52.

The state recognition information is supplied from the sensor input processor 50 to the model storage unit 51. Also, action information indicating the current or past action of the robot, for example, "I walked for a long time", is supplied from the action deciding unit 52 to the model storage unit 51. Thus, the model storage unit 51 generates different state information in accordance with the action of the robot indicated by action information, even if the same state recognition information is supplied.

That is, for example, when the robot greets the user and when the user pats the robot on the head, action information indicating that the robot greeted the user and state recognition information indicating that the robot was patted on the head are transmitted to the model storage unit 51. At this time, the value of the emotion model representing "joy" is increased in the model storage unit 51.

On the other hand, when the robot is patted on the head while it is doing a job, action information indicating that the robot is doing a job and state recognition information indicating that the robot was patted on the head are transmitted to the model storage unit 51. At this time, the value of the emotion model representing "joy" is not varied in the model storage unit 51.

In this way, the model storage unit 51 sets the value of the emotion model by referring to action information indicating the current or past action of the robot, as well as to state recognition information. Accordingly, for example, when the user pats the robot on the head as a joke while the robot is doing a task, the value of the emotion model representing "joy" does not increase, and thus unnatural variation in the emotion can be prevented.

Further, the model storage unit 51 also increases or decreases the value of the instinct model and the growth model based on both state recognition information and action information, as in the emotion model. Also, the model storage unit 51 increases or decreases the value of each of the emotion model, the instinct model, and the growth model, based on the value of the other models.

The action deciding unit 52 decides the subsequent action based on the state recognition information transmitted from the sensor input processor 50, the state information transmitted from the model storage unit 51, an elapsed time, and so on. Also, the action deciding unit 52 outputs the content of the decided action as action command information to the posture change unit 53.

That is, the action deciding unit 52 manages a limited automaton in which actions that may be done by the robot are related to states, as an action model for specifying the action of the robot. Also, the action deciding unit 52 changes the state in the limited automaton as the action model based on the state recognition information transmitted from the sensor input processor 50, the value of the emotion model, the instinct model, or the growth model in the model storage unit 51, an elapsed time, and so on, and then decides the subsequent action, which is the action corresponding to the state after the change.

Herein, when the action deciding unit 52 detects a predetermined trigger, it changes the state. That is, the action deciding unit 52 changes the state when a predetermined time has passed since an action corresponding to the current state started, when the action deciding unit 52 receives specific state recognition information, and when the value of the state of emotion, instinct, and growth indicated by the state information supplied from the model storage unit 51 reaches a predetermined threshold or surpasses the threshold, or decreases below the threshold.

As described above, the action deciding unit 52 changes the state in the action model based on the value of the emotion model, the instinct model, and the growth model of the model storage unit 51, as well as on the state recognition information transmitted from the sensor input processor 50. Therefore, when the same state recognition information is input to the action deciding unit 52, the changed state may be different depending on the value of the emotion model, the instinct model, and the growth model (state information).

As a result, when the state information indicates "I'm not angry" and "I'm not hungry", and when the state recognition information indicates "A hand is extended to the front of the eyes", the action deciding unit 52 generates action command information for allowing the robot to "shake hands" in accordance with the state that a hand is extended to the front of the eyes, and outputs the action command information to the posture change unit 53.

Also, when the state information indicates "I'm not angry" and "I'm hungry", and when the state recognition information indicates "A hand is extended to the front of the eyes", the action deciding unit 52 generates action command information for allowing the robot to "lick the hand" in accordance with the state that a hand is extended to the front of the eyes, and outputs the action command information to the posture change unit 53.

Also, when the state information indicates "I'm angry", and when the state recognition information indicates "A hand is extended to the front of the eyes", the action deciding unit 52 generates action command information for allowing the robot to "toss its head" even if the state information indicates "I'm hungry" or "I'm not hungry", and outputs the action command information to the posture change unit 53.

The action deciding unit 52 can decide the parameter of the action corresponding to the changed state, for example, the walking speed, the way of moving paws and legs and its speed, on the basis of the state of emotion, instinct, and growth indicated by the state information supplied from the model storage unit 51. In this case, action command information including the parameter is output to the posture change unit 53.

Also, as described above, the action deciding unit 52 generates action command information for allowing the robot to speak, as well as action command information for moving the head, paws, legs, and so on of the robot. The action command information for allowing the robot to speak is supplied to the speech synthesizer 55. The action command information supplied to the speech synthesizer 55 includes text corresponding to synthetic speech generated in the speech synthesizer 55. When the speech synthesizer 55 receives action command information from the action deciding unit 52, it generates synthetic speech based on the text included in the action command information and supplies the synthetic speech to the speaker 18 so that the speech is output. Accordingly, the voice of the robot, various requirements to the user, for example, "I'm hungry", a response to the user, for example, "What?", and so on are output from the speaker 18. Herein, the speech synthesizer 55 also receives state information from the model storage unit 51. Thus, the speech synthesizer 55 can generate synthetic speech by performing various controls based on the state of emotion indicated by the state information.

Further, the speech synthesizer 55 can generate synthetic speech by performing various controls based on the instinct or the state of the instinct, as well as the emotion. When the synthetic speech is output, the action deciding unit 52 generates action command information for opening and closing the lowerjaw portion 4A as required, and outputs the action command information to the posture change unit 53. At this time, the lowerjaw portion 4A opens and closes in synchronization with the output of the synthetic speech. Thus, the user receives an impression that the robot is speaking.

The posture change unit 53 generates posture change information for changing the current posture of the robot to the next posture based on the action command information supplied from the action deciding unit 52, and outputs the posture change information to the control unit 54.

Herein, the next posture which can be realized is decided in accordance with the physical shape of the robot, such as the shape and weight of the body, paws, and legs, and the connecting state between the units, and the mechanism of the actuators $3AA_1$ to $5A_1$ and $5A_2$, such as the bending direction and angle of the junctions.

Also, the next posture includes a posture which can be realized by directly changing the current posture and a posture which cannot be realized by directly changing the current posture. For example, the four-legged robot that is lying with its arms and legs stretching out can directly change its posture by lying down. However, that lying posture cannot be directly changed to a standing posture. In order to change the lying posture to the standing posture, two steps are required. That is, the robot first lies down by pulling its paws and legs close to the body, and then stands. Also, there is a posture which cannot be realized safely. For example, when the four-legged robot which is standing with the four legs tries to raise the front two legs so as to cheer, the robot easily falls down.

Accordingly, postures which can be realized by directly changing the previous posture are registered in the posture change unit 53 in advance. When the action command information supplied from the action deciding unit 52 indicates a posture which can be realized by directly changing the current posture, the action command information is output to the control unit 54 as it is, as posture change information. On the other hand, when the action command information indicates a posture which cannot be realized by directly changing the current posture, the posture change unit 53 generates posture change information so that the current posture is changed to another posture and then the required posture can be realized, and outputs the posture change information to the control unit 54. Accordingly, the robot does not forcedly take a posture which cannot be realized by directly changing the current posture, and thus falling down of the robot can be prevented.

The control unit 54 generates a control signal for driving the actuators $3AA_1$ to $5A_1$ and $5A_2$, in accordance with the posture change information transmitted from the posture change unit 53, and outputs the control signal to the actuators $3AA_1$ to $5A_1$ and $5A_2$. Accordingly, the actuators $3AA_1$ to $5A_1$ and $5A_2$ are driven in accordance with the control signal, and the robot acts autonomously.

Figure 4:
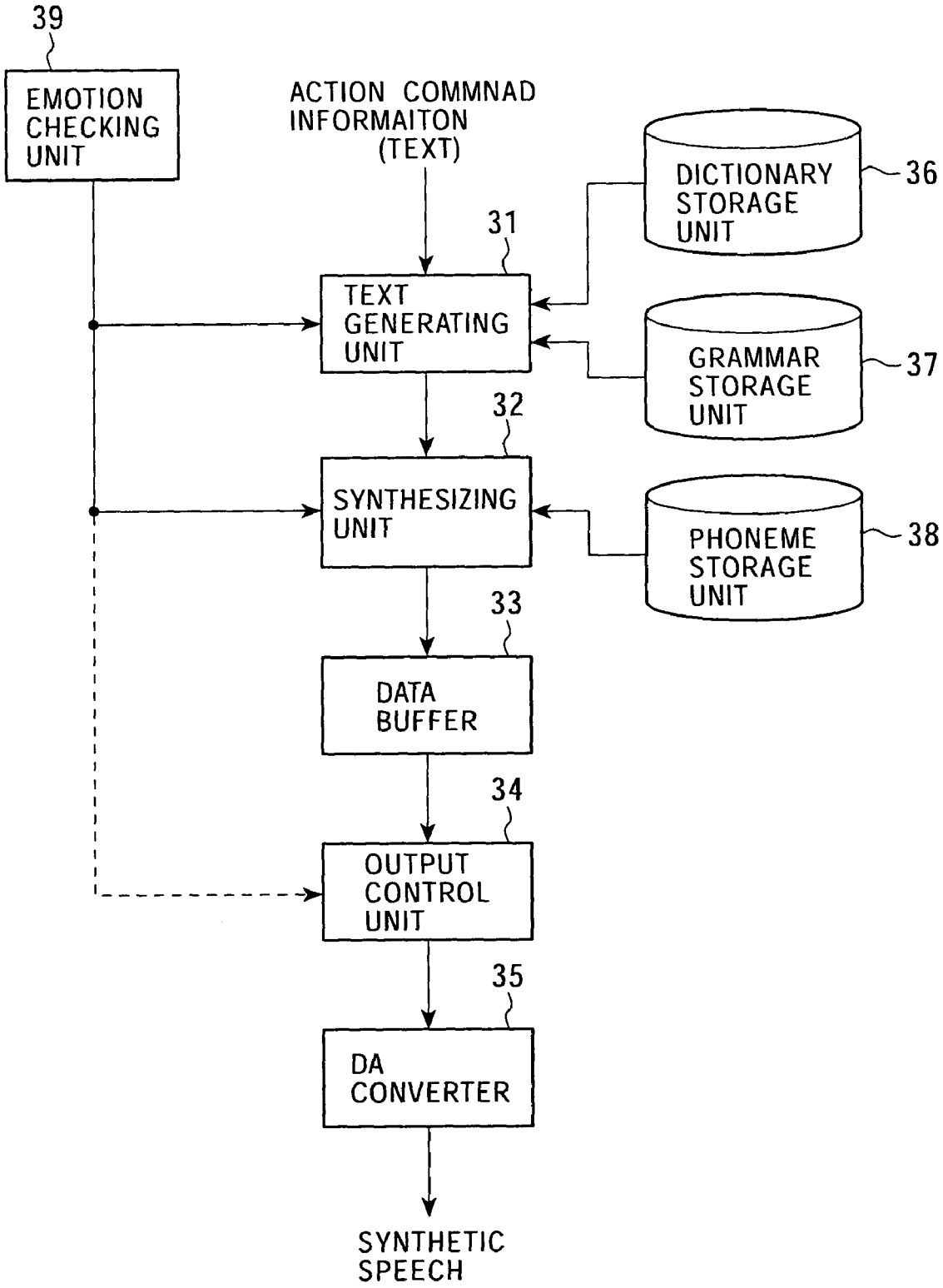
FIG. 4 is a block diagram showing an example the configuration of a speech synthesizer 55.

FIG. 4 shows an example of the configuration of the speech synthesizer 55 shown in FIG. 3.

Action command information which is output from the action deciding unit 52 and which includes text for speech synthesis is supplied to a text generating unit 31. The text generating unit 31 analyzes the text included in the action command information by referring to a dictionary storage unit 36 and a grammar storage unit 37.

That is, the dictionary storage unit 36 stores a dictionary including information, such as information about part of speech, pronunciation, and accent of words. The grammar storage unit 37 stores grammatical rules such as constraint of a word chain about the words included in the dictionary stored in the dictionary storage unit 36. The text generating unit 31 analyzes the morpheme and the sentence structure of the input text based on the dictionary and the grammatical rules. Then, the text generating unit 31 extracts information which is required for speech synthesis by rule, which is performed in a synthesizing unit 32 at the subsequent stage. Herein, the information required for performing speech synthesis by rule includes prosody information such as information for controlling the position of a pause, accent, and intonation, and phonological information such as the pronunciation of the words.

The information obtained in the text generating unit 31 is supplied to the synthesizing unit 32, which generates speech data (digital data) of synthetic speech corresponding to the text input to the text generating unit 31 by using a phoneme storage unit 38.

That is, the phoneme storage unit 38 stores phoneme data in forms of, for example, CV (consonant-vowel), VCV, and CVC. The synthesizing unit 32 connects required phoneme data based on the information from the text generating unit 31 and adequately adds pause, accent, intonation, and so on so as to generate synthetic speech data corresponding to the text input to the text generating unit 31.

The speech data is supplied to a data buffer 33. The data buffer 33 stores synthetic speech data supplied from the synthesizing unit 32.

An output control unit 34 controls reading of synthetic speech data stored in the data buffer 33.

That is, the output control unit 34 is synchronized with a digital-analogue (DA) converter 35 in the subsequent stage, reads synthetic speech data from the data buffer 33, and supplies the data to the DA converter 35. The DA converter 35 DA-converts the synthetic speech data as a digital signal to a speech signal as an analog signal and supplies the speech signal to the speaker 18. Accordingly, synthetic speech corresponding to the text input to the text generating unit 31 is output.

An emotion checking unit 39 checks the value of the emotion model stored in the model storage unit 51 (emotion model value) regularly or irregularly, and supplies the result to the text generating unit 31 and the synthesizing unit 32. The text generating unit 31 and the synthesizing unit 32 perform a process in consideration of the emotion model value supplied from the emotion checking unit 39.

Figure 5:
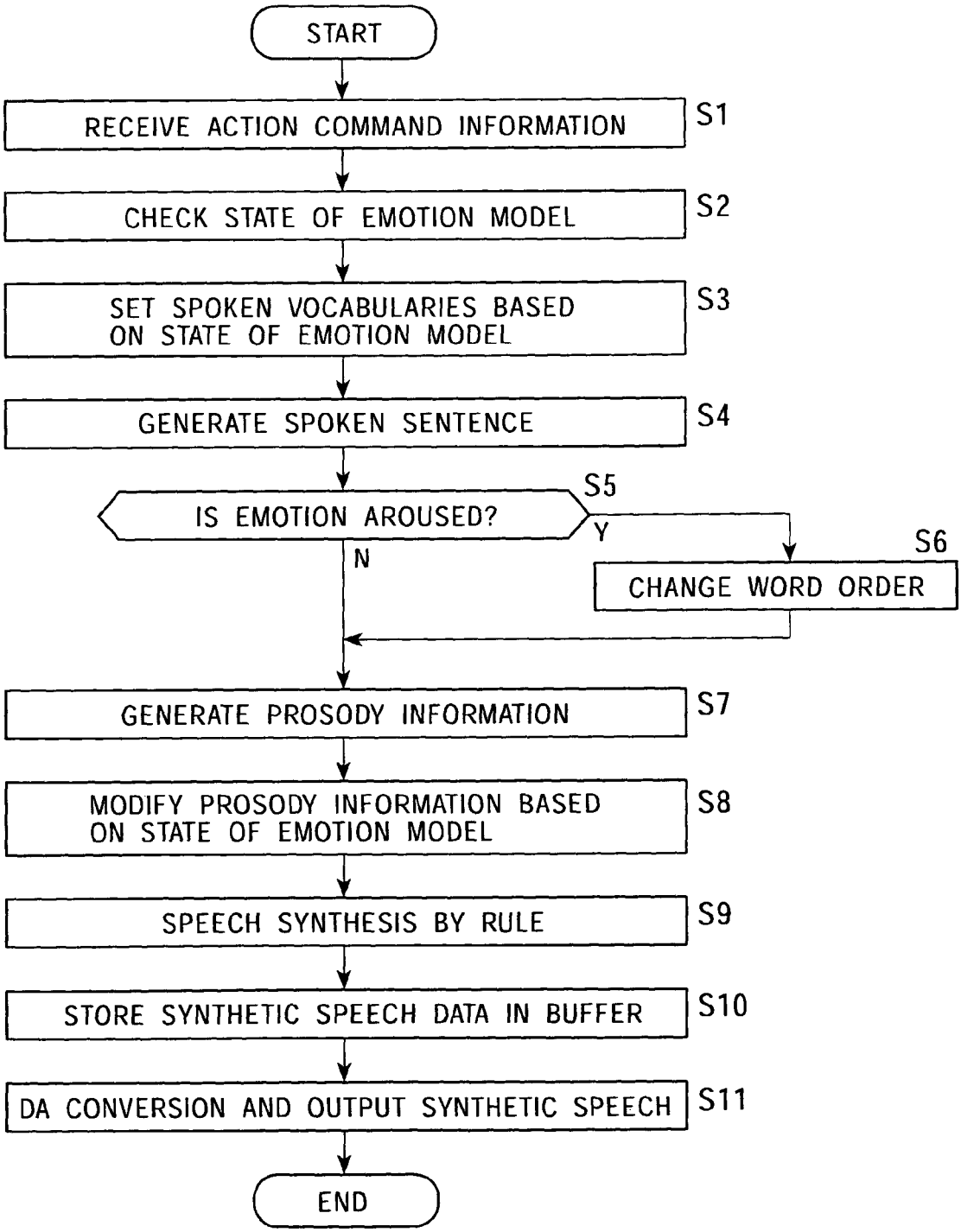
FIG. 5 is a flowchart for illustrating a process of synthesizing speech performed by the speech synthesizer 55.

Next, a process of synthesizing speech performed by the speech synthesizer 55 shown in FIG. 4 will be described with reference to the flowchart shown in FIG. 5.

When the action deciding unit 52 outputs action command information including text for speech synthesis to the speech synthesizer 55, the text generating unit 31 receives the action command information in step S1, and the process proceeds to step S2. In step S2, the emotion checking unit 39 recognizes (checks) the emotion model value by referring to the model storage unit 51. The emotion model value is supplied from the emotion checking unit 39 to the text generating unit 31 and the synthesizing unit 32 so that the process proceeds to step S3.

In step S3, the text generating unit 31 sets the vocabulary (spoken vocabulary) used for generating text to be actually output as synthetic speech (hereinafter, referred to as spoken text) from the text included in the action command information transmitted from the action deciding unit 52, on the basis of the emotion model value, and the process proceeds to step S4. In step S4, the text generating unit 31 generates spoken text corresponding to the text included in the action command information by using the spoken vocabulary set in step S3.

That is, the text included in the action command information transmitted from the action deciding unit 52 is premised on, for example, speech in a normal emotion state. In step S4, the text is modified in consideration of the emotion state of the robot so that the spoken text is generated.

More specifically, when the text included in the action command information is "What?" and when the robot is angry, spoken text "What!?" for expressing the anger is generated. When the text included in the action command information is "Please stop it." and when the robot is angry, spoken text "Stop it!" for expressing the anger is generated.

Then, the process proceeds to step S5, and the emotion checking unit 39 determines whether or not the emotion of the robot is aroused based on the emotion model value recognized in step S2.

That is, as described above, the emotion model value represents the state (level) of emotions such as "joy", "sadness", "anger", and "delight" with a value in a predetermined range. Thus, when the value of one of the emotions is high, that emotion is considered to be aroused. Accordingly, in step S5, it can be determined whether or not the emotion of the robot is aroused by comparing the emotion model value of each emotion with a predetermined threshold.

When it is determined that the emotion is aroused in step S5, the process proceeds to step S6, where the emotion checking unit 39 outputs a change signal for instructing change of order of the words constituting the spoken text to the text generating unit 31.

In this case, the text generating unit 31 changes the order of the word sequence constituting the spoken text based on the change signal from the emotion checking unit 39 so that the predicate of the spoken text is positioned at the head of the sentence.

For example, when the spoken text is a negative sentence: "Watashi wa yatte imasen." (I didn't do it.), the text generating unit 31 changes the word order and make a sentence: "Yatte imasen, watashi wa." (It wasn't me who did it.) Also, when the spoken text is "Anata wa nan to iu koto o suru no desuka?" (What are you doing!?) expressing anger, the text generating unit 31 changes the word order and makes a sentence: "Nan to iu koto o suru no desuka, anata wa?" (What are you doing, you!?) Also, when the spoken text is "Watashi mo sore ni sansei desu." (I agree with it, too) expressing agreement, the text generating unit 31 changes the word order and makes a sentence: "Sansei desu, watashi mo sore ni." (I agree with it, I do.) Also, when the spoken text is "Kimi wa kirei da." (You are beautiful.) expressing praise, the text generating unit 31 changes the word order and makes a sentence "Kirei da, kimi wa." (You are beautiful, you are.)

As described above, when the word order of the spoken text is changed so as to place the predicate at the head of the sentence, the predicate is emphasized. Thus, spoken text for giving the impression that a strong emotion is expressed compared to the spoken text before the change can be obtained.

The method of changing the word order is not limited to the above-described method.

After the word order of the spoken text is changed in step S6, the process proceeds to step S7.

On the other hand, when it is determined that the emotion is not aroused in step S5, the step S6 is skipped and the process proceeds to step S7. Therefore, in this case, the word order of the spoken text is not changed and is left as it is.

In step S7, the text generating unit 31 performs a text analysis such as a morphological analysis and a sentence structure analysis with respect to the spoken text (whose word order is changed or not changed), and generates prosody information, such as a pitch frequency, power, and duration, which is required information for performing speech synthesis by rule for the spoken text. Further, the text generating unit 31 also generates phonological information, such as the pronunciation of each word constituting the spoken text. In step S7, standard prosody information is generated as the prosody information of the spoken text.

After that, the process proceeds to step S8, where the text generating unit 31 modifies the prosody information of the spoken text generated in step S7 based on the emotion model value supplied from the emotion checking unit 39. Accordingly, the emotional expression of the spoken text which is output in a form of synthetic speech is emphasized. Specifically, the prosody information is modified, for example, the accent is emphasized or the sentence ending is emphasized.

The phonological information and the prosody information of the spoken text obtained in the text generating unit 31 are supplied to the synthesizing unit 32. In step S9, the synthesizing unit 32 performs speech synthesis by rule in accordance with the phonological information and the prosody information so as to generate digital data (synthetic speech data) of synthetic speech of the spoken text. Herein, when the synthesizing unit 32 performs speech synthesis by rule, prosody such as the position of a pause, the position of accent, and intonation of the synthetic speech can be varied by the synthesizing unit 32 so as to adequately express the state of emotion of the robot based on the emotion model value supplied from the emotion checking unit 39.

The synthetic speech data obtained in the synthesizing unit 32 is supplied to the data buffer 33, and the data buffer 33 stores the synthetic speech data in step S10. Then, in step S11, the output control unit 34 reads the synthetic speech data from the data buffer 33 and supplies the data to the DA converter 35 so that the process is completed. Accordingly, the synthetic speech corresponding to the spoken text is output from the speaker 18.

As described above, since the word order of the spoken text is changed based on the state of the emotion of the robot, emotionally expressive synthetic speech can be output. As a result, for example, an aroused emotion of the robot can be expressed to the user.

In the above description, the present invention is applied to an entertainment robot (robot as a pseudo-pet). However, the present invention is not limited to this and Can be widely applied to, for example, an interactive system in which an internal state such as emotion is introduced to a system.

Also, the present invention can be applied to a virtual robot which is displayed on a display device such as a liquid crystal display, as well as to a real robot. When the present invention is applied to a virtual robot (or when the present invention is applied to a real robot having a display device), spoken text in which the word order has been changed is not output as synthetic speech, or is output as synthetic speech and can be displayed on the display device.

In this embodiment, the above-described series of processes are performed by allowing the CPU 10A to execute a program. However, the series of processes can be performed by using dedicated hardware.

Herein, the program may be stored in the memory 10B (FIG. 2) in advance. Also, the program may be temporarily or permanently stored (recorded) in a removable recording medium, such as a floppy disc, a compact disc read only memory (CD-ROM), a magneto optical (MO) disc, a digital versatile disc (DVD), a magnetic disc, or a semiconductor memory. The removable recording medium can be provided as so-called package software so as to be installed on the Robot (memory 10B).

Alternatively, the program can be wirelessly transferred from a download site through an artificial satellite for digital satellite broadcasting, or transferred with wire through a network such as a local area network (LAN) or the Internet, and can be installed on the memory 10B.

In this case, when the version of the program is upgraded, the version-upgraded program can be easily installed on the memory 10B.

In the description, the steps describing the program for allowing the CPU 10A to perform various processes do not have to be performed in time-series in the order described in the flowchart. The steps may be performed in parallel or independently (for example, parallel process or process by an object).

Further, the program may be executed by one CPU or may be executed by a plurality of CPUs in a distributed manner.

The speech synthesizer 55 shown in FIG. 4 can be realized by dedicated hardware or software. When the speech synthesizer 55 is realized by software, a program constituting the software is installed on a multi-purpose computer or the like.

Figure 6:
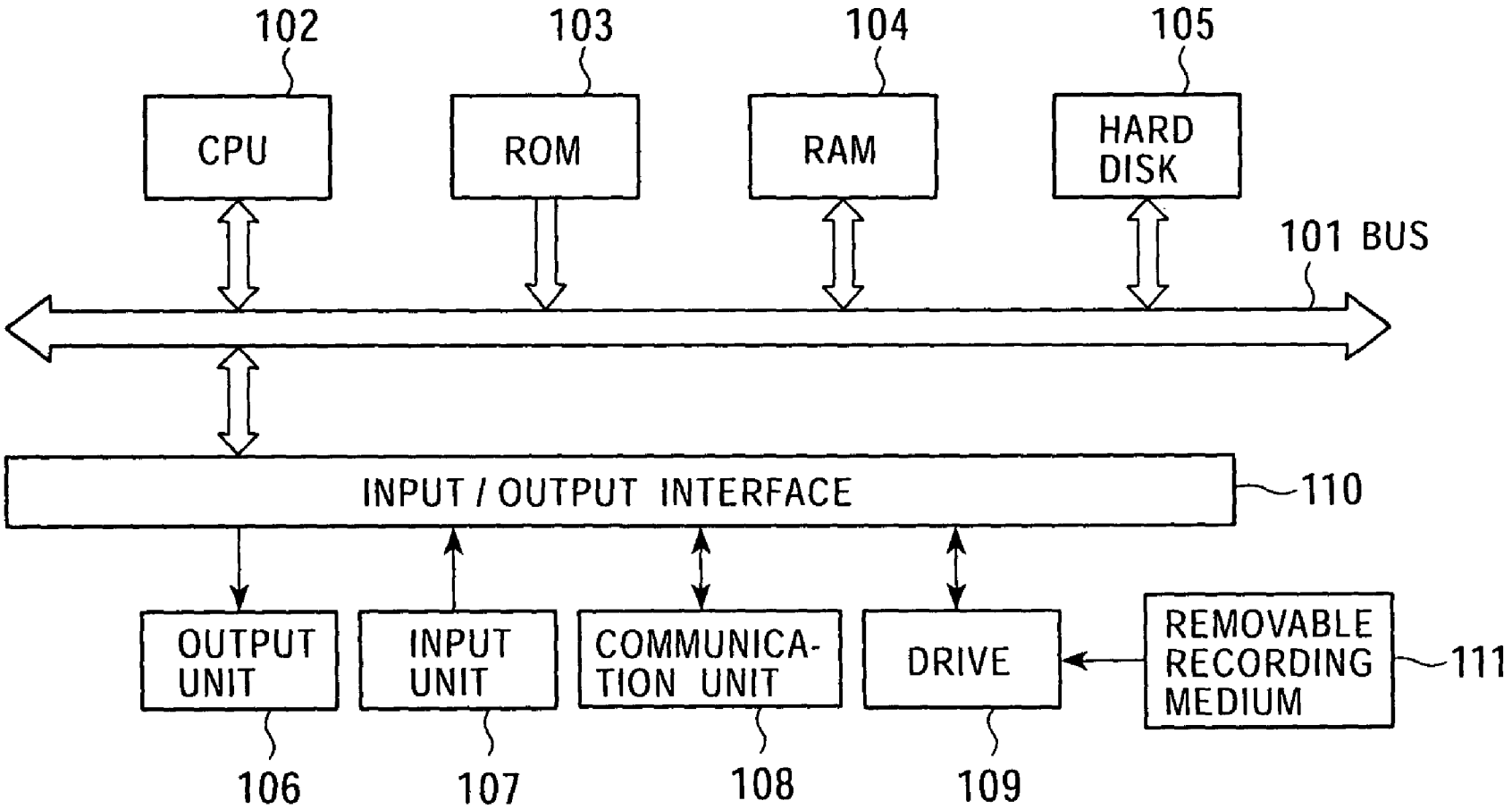
FIG. 6 is a block diagram showing an example of the configuration of a computer according to an embodiment of the present invention.

FIG. 6 shows an example of the configuration of a computer according to an embodiment, a program for realizing the speech synthesizer 55 being installed thereon.

The program can be previously recorded in a hard disk 105 or a ROM 103 as recording media included in the computer.

Alternatively, the program can be temporarily or permanently stored (recorded) in a removable recording medium 111, such as a floppy disc, a CD-ROM, an MO disc, a DVD, a magnetic disc, or a semiconductor memory. The removable recording medium 111 can be provided as so-called package software.

The program can be installed from the above-described removable recording medium 111 on the computer. Alternatively, the program can be wirelessly transferred from a download site through an artificial satellite for digital satellite broadcasting to the computer. Also, the program can be transferred with wire through a network such as a LAN or the Internet to the computer. A communication unit 108 of the computer receives the transferred program so that the program is installed on the hard disk 105.

The computer includes a central processing unit (CPU) 102. An input/output interface 110 is connected to the CPU 102 through a bus 101. When a user operates an input unit 107 including a keyboard, mouse, and microphone so that a command is input to the CPU-102 through the input/output interface 110, the CPU 102 executes the program stored in the read only memory (ROM) 103. Alternatively, the CPU 102 loads the program stored in the hard disk 105, the program which is transferred through a satellite or a network, is received by the communication unit 108, and is installed on the hard disk 105, or the program which is read from the removable recording medium 111 loaded on a drive 109 and which is installed on the hard disk 105 to a random access memory (RAM) 104 and executes the program. Accordingly, the CPU 102 performs the process according to the above-described flowchart or the process performed by the configuration of the block diagram. Then, the CPU 102 outputs the result of the process from an output unit 106 including a liquid crystal display (LCD) and a speaker through the input/output interface 110, or transmits the result from the communication unit 108, or record the result on the hard disk 105 as required.

In this embodiment, synthetic speech is generated from the text which is generated by the action deciding unit 52. However, the present invention can be applied when synthetic speech is generated from text prepared in advance. Furthermore, the present invention can be applied when required synthetic speech is generated by editing speech data which is recorded in advance.

Also, in this embodiment, the word order of the spoken text is changed, and synthetic speech data is generated after the change of the word order. However, it is possible to generate synthetic speech data from the spoken text before changing the word order and then change the word order by operating the synthetic speech data. The operation of the synthetic speech data may be performed by the synthesizing unit 32 shown in FIG. 4. Alternatively, as shown by a broken line of FIG. 4, the emotion model value may be supplied from the emotion checking unit 39 to the output control unit 34 so that the operation is performed by the output control unit 34.

Further, the change of word order may be performed based on the internal state of the pet robot, such as the instinct and growth, as well as on the emotion model value.

INDUSTRIAL APPLICABILITY

As described above, according to the present invention, a word sequence is output in accordance with control of an information processor. On the other hand, the word order of the output word sequence is changed based on the internal state of the information processor. Accordingly, for example, emotionally expressive synthetic speech can be output.

The invention claimed is:

1. A word sequence output device for outputting a word sequence in accordance with control of an information processor, the device comprising:

output means for outputting the word sequence in accordance with control of the information processor; and changing means for changing the word order of the word sequence output by the output means based on the internal state of the information processor, wherein the information processor is a real or virtual device, and wherein the information processor includes an emotion state as the internal state, and the changing means changes the word order of the word sequence based on the emotion state.

2. The device according to claim 1, wherein the output means outputs the word sequence in a form of speech or text.

3. The device according to claim 1, wherein the changing means changes the word order of the word sequence so tat the predicate of a sentence formed by the word sequence is placed at the head of the sentence.

4. A method of outputting a word sequence in accordance with control of an information processor, the method comprising:

an output step for outputting the word sequence in accordance with control of the information processor; and a changing step for changing the word order of the word sequence output in the output step, on the basis of the internal state of the information processor, wherein the information processor is a real or virtual device, and wherein the information processor includes an emotion state as the internal state, and the changing means changes the word order of the word sequence based on the emotion state.

5. A recording medium having recorded thereon a computer program that when executed on a processor causes the processor to execute a method of outputting a word sequence in accordance with control of an information processor, the method comprising:

an output step for outputting the word sequence in accordance with control of the information processor; and a changing step for changing the word order of the word sequence output in the output step, on the basis of the internal state of the information processor, wherein the information processor is a real or virtual device, and wherein the information processor includes an emotion state as the internal state, and the changing means changes the word order of the word sequence based on the emotion state.

* * * * *